US007485817B2

(12) United States Patent
Gottschalk

(10) Patent No.: US 7,485,817 B2
(45) Date of Patent: Feb. 3, 2009

(54) ELECTRICAL SWITCHING APPARATUS AND ADJUSTABLE MOUNTING ASSEMBLY THEREFOR

(75) Inventor: Andrew L. Gottschalk, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 575 days.

(21) Appl. No.: 11/235,499

(22) Filed: Sep. 26, 2005

(65) Prior Publication Data

US 2008/0001688 A1 Jan. 3, 2008

(51) Int. Cl.
*H01H 9/00* (2006.01)
*H01H 11/00* (2006.01)

(52) U.S. Cl. ..... 200/50.21; 200/50.17; 200/50.23; 361/605; 361/606

(58) Field of Classification Search ..... 200/50.17, 200/50.21–50.27; 361/605–609
See application file for complete search history.

(56) References Cited

U.S. PATENT DOCUMENTS 5,486,978 A 1/1996 Fishovitz
6,244,891 B1 * 6/2001 Robbins et al. ..... 439/372
6,561,604 B2 5/2003 Leccia et al.

* cited by examiner

*Primary Examiner*—Ramon M Barrera
(74) *Attorney, Agent, or Firm*—Martin J. Moran

(57) ABSTRACT

An adjustable mounting assembly for a power circuit breaker includes a frame having a first sidewall disposed opposite a first side of the housing of the power circuit breaker and a second sidewall disposed opposite the second side of the housing. At least one moveable block is disposed between the first and second sidewalls of the frame and the corresponding first and second sides of the housing. An adjustment mechanism, such as a jackscrew coupled to the moveable block, adjusts in order to move the block into engagement with the corresponding sides of the housing. A fastening mechanism, such as a lock screw, secures the moveable block and the frame with respect to the housing. The adjustable mounting assembly securely mounts the frame and the power circuit breaker within a switchgear enclosure in order to resist damage potentially caused by an impact force sustained thereby.

12 Claims, 3 Drawing Sheets

ELECTRICAL SWITCHING APPARATUS AND ADJUSTABLE MOUNTING ASSEMBLY THEREFOR

BACKGROUND OF THE INVENTION

1. Field of the Invention

The present invention relates generally to electrical switching apparatus and, more particularly, to a circuit breaker including an adjustable mounting assembly. The invention also relates to an adjustable mounting assembly for circuit breakers.

2. Background Information

In certain applications, such as, for example and without limitation, naval applications (e.g., without limitation, water-based vehicles, such as ships, boats, aircraft carriers, other vessels for travel on water, and submarines, or other vehicles for travel under water), electrical equipment must be designed to withstand large shock loads (e.g., up to about 1000 times the force of gravity, or more). Such shock loads include, for example, impact loads resulting from a direct hit by a torpedo, depth charge, missile, other ammunition or impact force, as well as residual or aftershock loads caused, for example, by a nearby indirect explosion, such as the detonation of a depth charge. All shock loads can severely damage the electrical equipment. Accordingly, electrical components for such applications must be designed to withstand much larger loads than typically experienced by electrical equipment employed in conventional civilian or commercial applications.

For instance, a shock load of about 1000 times the force of gravity would be expected to crack or otherwise damage the molded (e.g., without limitation, plastic) housing of a commercial power circuit breaker. Additionally, it is generally well known that power circuit breakers are typically large in size and relatively heavy and are, therefore, often mounted with other switchgear in a cabinet or other enclosure. Accordingly, in order to facilitate insertion and removal of the circuit breakers with respect to the enclosure, power circuit breakers are typically mounted within a frame, known as a cassette, which may be drawn into and out of the cabinet. Hence, the "draw-out" designation is commonly associated with this type of switchgear configuration. In addition to the aforementioned undesired cracking of the molded housing of the circuit breaker, large shock loads could further cause the power circuit breaker to vibrate within, or separate or break-away from the cassette.

There is, therefore, room for improvement in circuit breakers for use in applications where the circuit breaker must be capable of withstanding a high load, such as a shock load, and in adjustable mounting assemblies for such circuit breakers.

SUMMARY OF THE INVENTION

These needs and others are met by the present invention, which is directed to an adjustable mounting assembly for a circuit breaker.

As one aspect of the invention, an adjustable mounting assembly is provided for an electrical switching apparatus including a housing. The electrical switching apparatus is structured to be disposed in an enclosure. The adjustable mounting assembly comprises: a frame structured to couple the housing of the electrical switching apparatus to the enclosure; a number of adjustable members structured to be disposed between the frame and the housing; an adjustment mechanism coupled to each one of the adjustable members and structured to move the adjustable member into engagement with the housing; and a fastening mechanism structured to secure the adjustable member and the frame with respect to the housing. The adjustable mounting assembly is structured to securely mount the frame and the electrical switching apparatus within the enclosure in order to resist damage potentially caused by an impact force sustained by the electrical switching apparatus.

The housing of the electrical switching apparatus may have a first side and a second side wherein the frame comprises a first sidewall structured to be disposed opposite the first side of the housing, and a second sidewall structured to be disposed opposite the second side of the housing. The number of adjustable members may include at least one adjustable member disposed between each of the first sidewall of the frame and the first side of the housing, and the second sidewall of the frame and the second side of the housing. Each of the first and second sidewalls may include a bracket having an engagement portion and a guide portion wherein the adjustable member is disposed within the guide portion of the bracket, wherein the engagement portion is structured to engage a corresponding one of the first and second sides of the housing of the electrical switching apparatus at a first location, and wherein the adjustable member is structured to move within the guide portion of the bracket in order to engage the corresponding one of the first and second sides at a second location.

The adjustable member may comprise a moveable block including a number of slots and the fastening mechanism may comprise a fastener disposed within each one of the slots. When the adjustment mechanism is adjusted, the moveable block may be moved within the guide portion until engagement at the second location is achieved and, when the engagement is achieved, the fastener may be tightened in order to maintain the position of the moveable block. The fastener may comprise at least one lock screw, and the adjustment mechanism may comprise a jack screw.

The bracket may include as the guide portion, a first guide portion and a second guide portion. The moveable block may include first and second moveable blocks disposed within the first and second guide portions, respectively, and each of the first and second moveable blocks may include one jack screw and a first slot and a second slot each having one lock screw disposed therein. The locking mechanism may further include at least one locknut disposed on the jack screw wherein the locknut is structured to be tightened on the jack screw in order to further secure the position of the moveable block. The bracket may be made from a metallic material wherein the engagement portion of the bracket includes a resilient protector structured to further resist the aforementioned damage potentially caused by the impact force. The bracket may be coupled to the first and second sidewalls by a plurality of fasteners wherein the fasteners are structured to be tightened and loosed in order to adjust the bracket thereby further facilitating adjustment and securement between the frame and the housing of the electrical switching apparatus.

The electrical switching apparatus may be a power circuit breaker and the frame may comprise a draw-out cassette structured to be coupled to the enclosure in order to facilitate insertion and withdrawal of the power circuit breaker with respect to the enclosure.

As another aspect of the invention, an electrical switching apparatus comprises: a switchgear enclosure; a housing including a first side and a second side; an electrical switching device housed by the housing; and an adjustable mounting assembly for securely mounting the housing and the electrical switching device within the switchgear enclosure, the adjustable mounting assembly comprising: a frame including a first sidewall disposed opposite the first side of the housing, and a second sidewall disposed opposite the second side of the housing, the frame coupling the housing of the electrical switching apparatus to the switchgear enclosure, at least one adjustable member disposed between at least one of the first and second sidewalls of the frame and a corresponding one of the first and second sides of the housing, an adjustment mechanism coupled to the adjustable member and being adjusted in order to move the adjustable member into engagement with the corresponding one of the first and second sides of the housing, and a fastening mechanism securing the adjustable member and the frame with respect to the housing, wherein the adjustable mounting assembly securely mounts the frame and the electrical switching device within the switchgear enclosure in order to resist damage potentially caused by an impact force sustained thereby.

The first and second sidewalls of the frame may include a bracket having an engagement portion and a guide portion wherein at least one adjustable member is disposed within the guide portion of the bracket and the engagement portion engages a corresponding one of the first and second sides of the housing of the electrical switching apparatus at a first location, which may be a recess, and the adjustable member moves within the guide portion of the bracket in order to engage the corresponding side at a second location, which may be a generally horizontal bearing surface.

The electrical switching device may be a power circuit breaker device wherein the frame comprises a draw-out cassette coupled to the switchgear enclosure in order to facilitate insertion and withdrawal of the power circuit breaker device with respect to the switchgear enclosure.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
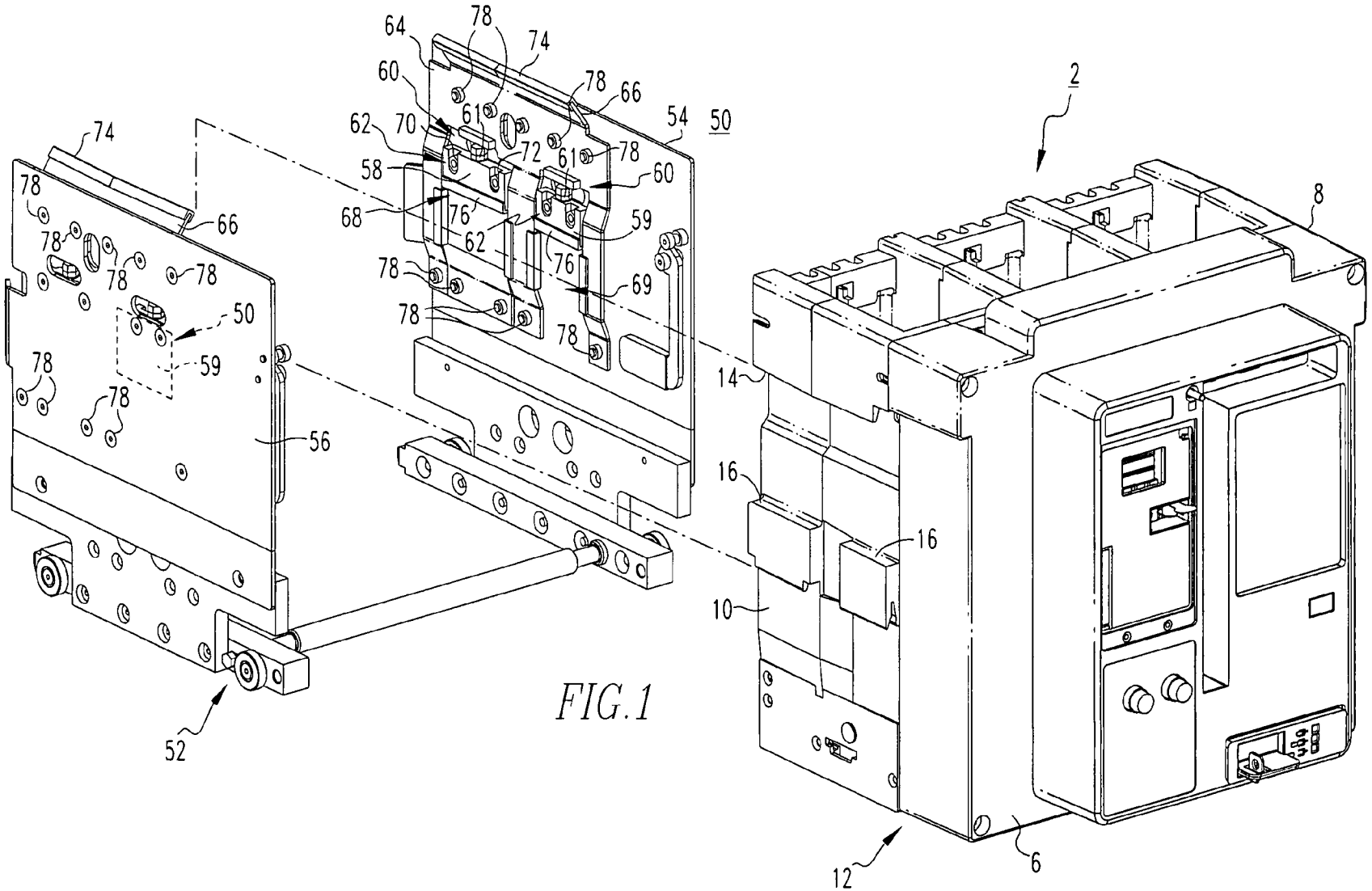
FIG. 1 is an exploded isometric view of a power circuit breaker and adjustable mounting assembly therefor, in accordance with the invention.

For purposes of illustration, the invention will be described as applied to electrical apparatus employed in naval applications (e.g., without limitation, water-based vehicles, such as ships, boats, aircraft carriers, other vessels for travel on water, and submarines, or other vehicles for travel under water), although it will become apparent that it could also be applied to other applications such as, for example, in a land vehicle, air vehicle, or other suitable structure.

Directional phrases used herein, such as, for example, up, down, top, bottom, left, right and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers (e.g., without limitation, lock washers) and nuts.

As employed herein, the statement that two or more parts are "coupled" together shall mean that the parts are joined together either directly or joined through one or more intermediate parts.

As employed herein, the term "number" shall mean one or more than one (i.e., a plurality).

As employed herein, the term "structure" shall expressly include, but not be limited by, a building, roofed and/or walled structure built for permanent or temporary use, structure for a land vehicle, structure for a water-based vehicle (as previously defined herein), structure for an air vehicle, or structure for another motor vehicle.

As employed herein, the term "land vehicle" shall expressly include, but not be limited by, any land-based vehicles having pneumatic tires, any rail-based vehicles, any maglev vehicles, automobiles, trucks, sport-utility vehicles (SUVs), recreational vehicles, all-terrain vehicles, vans, buses, campers or trailers.

As employed herein, the term "air vehicle" shall expressly include, but not be limited by, any air-based vehicles, airplanes, jets, aircraft, airships, balloons, blimps, or dirigibles.

FIG. 1 shows an electrical switching apparatus 2 employing an adjustable mounting assembly 50 in accordance with the invention. The electrical switching apparatus which, in the example of FIG. 1, is a draw-out power circuit breaker 2, includes a switchgear enclosure 4 (FIG. 3A), a housing 6 including a first side 8 and a second side 10, an electrical switching device 12 housed by the housing 6, and the adjustable mounting assembly 50. The electrical switching device 12 in the example of FIG. 1 is a power circuit breaker device 12, although it will be appreciated that the adjustable mounting assembly 50 of the invention could also be employed with any other known or suitable type of electrical switching apparatus (e.g., without limitation, circuit switching devices and other circuit interrupters such as contactors, motor starters, motor controllers and other load controllers).

Figure 2:
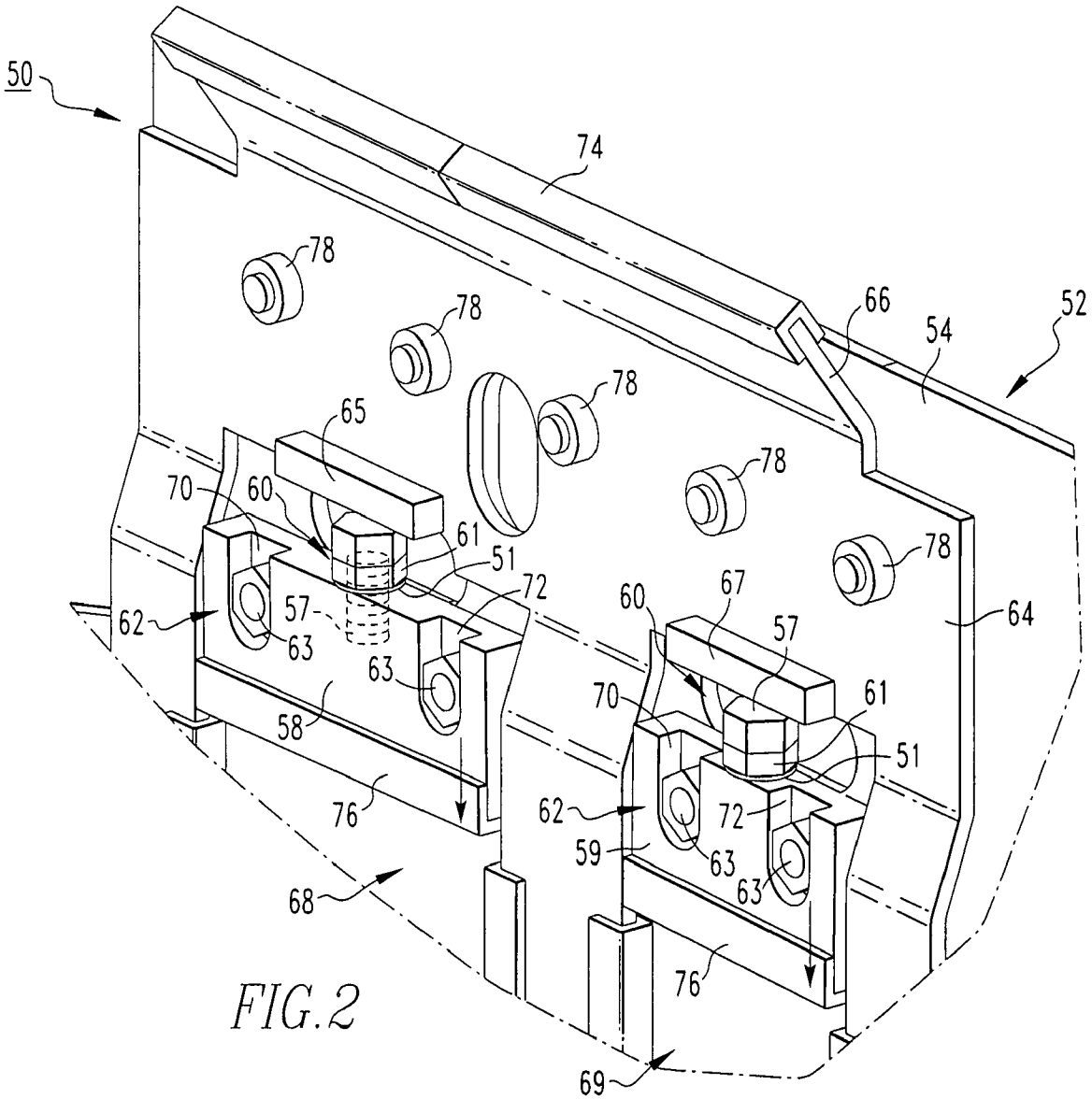
FIG. 2 is an isometric view of a portion of the adjustable mounting assembly of FIG. 1.
Figure 3B:
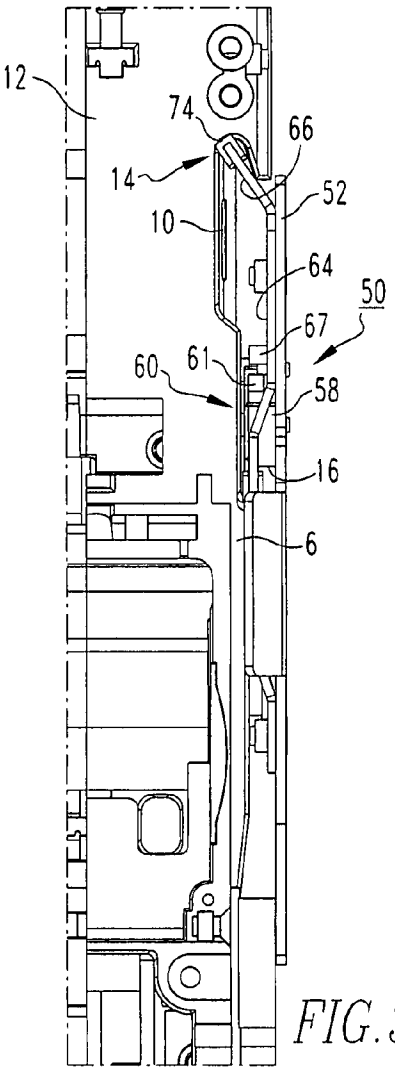
FIG. 3B is a vertical elevational back view of a portion of the power circuit breaker of FIG. 3A showing engagement between the adjustable mounting assembly and the housing of the power circuit breaker.
Figure 3A:
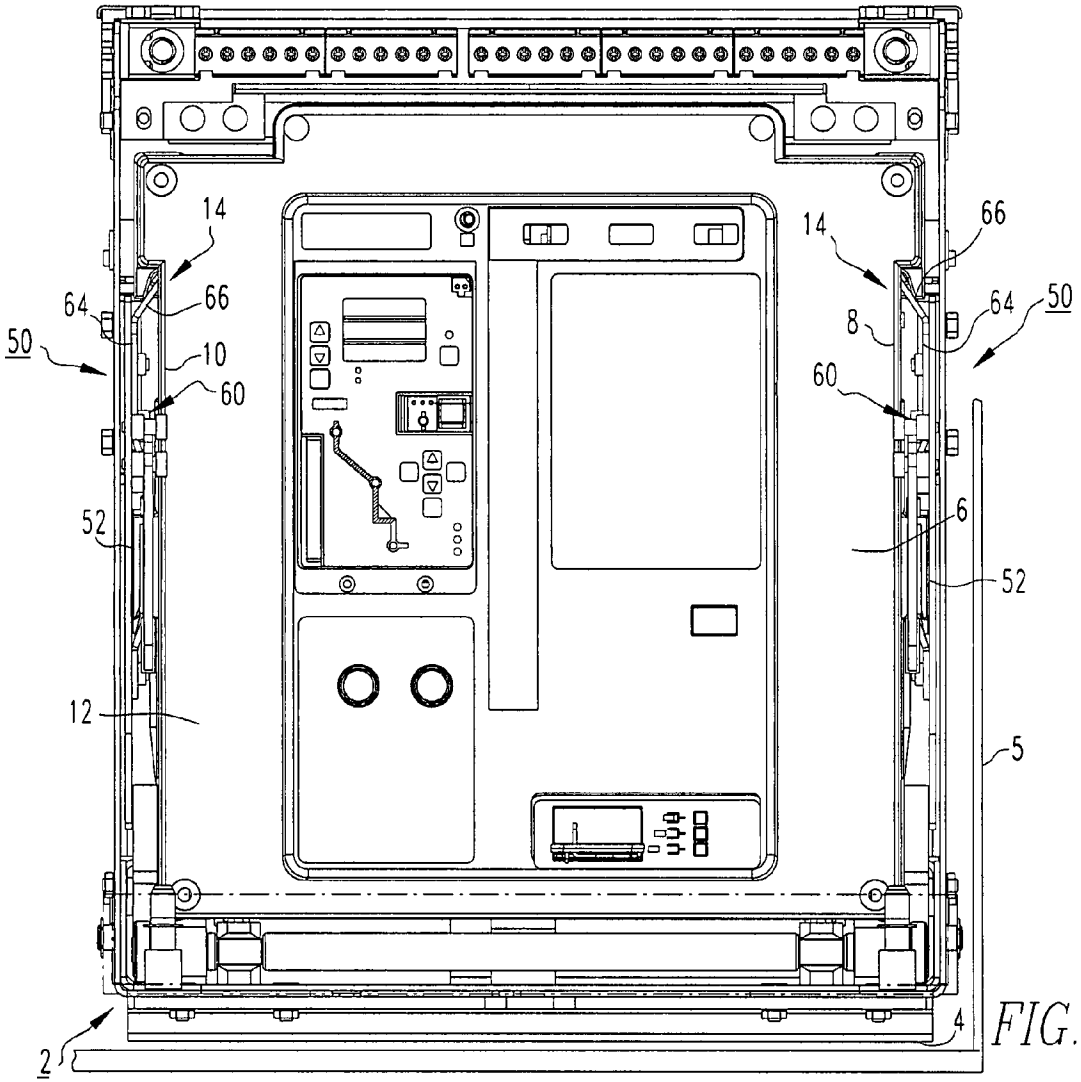
FIG. 3A is a vertical elevational view of the power circuit breaker and adjustable mounting assembly therefor of FIG. 1, shown mounted within a draw-out cassette.

The adjustable mounting assembly 50 is structured to securely mount the housing 6 and the power circuit breaker device 12 within the switchgear enclosure 4 (FIG. 3A). Specifically, as shown in FIGS. 1 and 2, the adjustable mounting assembly 50 includes a frame 52 having a first sidewall 54 and a second sidewall 56. The first sidewall 54 is structured to be disposed opposite the first side 8 of the housing 6 of the power circuit breaker device 12 and the second sidewall 56 is disposed opposite the second side 10 of the housing 6. In this manner, the frame 52 couples the housing 6 of the power circuit breaker 2 to the switchgear enclosure 4 (see, for example, FIG. 3A). The switchgear enclosure which, in the example shown and described herein is a cassette 4 (FIG. 3A), is then permanently mounted within a secondary enclosure 5 (FIG. 3A) such as, for example and without limitation, a rack or a switchgear cabinet.

More specifically, at least one adjustable member 58, 59 is disposed between at least one of the first and second sidewalls 54, 56 of the frame 52 and a corresponding one of the first and second sides 8, 10 of the housing 6. In the example of FIGS. 1 and 2, a pair of adjustable members which comprise first and second moveable blocks 58, 59, are disposed on each sidewall 54, 56 (only first moveable block 59 is shown on sidewall 56, in hidden line drawing, in FIG. 1). An adjustment mechanism 60 is coupled to each moveable block 58, 59 and is structured to be adjusted in order to move the moveable block 58, 59 into engagement with the corresponding one of the first and second sides 8, 10 of the housing 6 (see, for example, first moveable block 59 engaging generally horizontal bearing surface 16 of housing 6 in FIG. 3B). A fastening mechanism 62 which, in the examples of FIGS. 1 and 2 comprises a number of lock screws 63, is structured to secure the moveable blocks 58, 59 and the frame 52 with respect to housing 6. In this manner, the adjustable mounting assembly 50 of the invention securely mounts the frame 52 and the power circuit breaker device 12 within the switchgear enclosure 4 in order to resist damage potentially caused by an impact force sustained thereby. As previously discussed, such impact forces expressly include, but are not limited to, shock loads, such as, for example, impact loads resulting from a direct hit by a torpedo, depth charge, missile, other ammunition or impact force, and also include residual or aftershock loads caused, for example, by a nearby indirect explosion, such as the detonation of a depth charge. All such loads can severely damage the power circuit breaker 2. The adjustable mounting assembly 50 of the present invention substantially resists such damage.

Continuing to refer to FIG. 2, and also to FIGS. 3A and 3B, the adjustable mounting assembly 50 of the invention and the operation of the same will be further understood. For simplicity of disclosure, the adjustable mounting assembly 50 will only be described with respect to the first sidewall 54 of frame 52. It will be appreciated, however, that the same adjustable mounting assembly structure is essentially identical on the second sidewall 56.

Specifically, a bracket 64 is attached to sidewall 54 using a plurality of fasteners 78. The fasteners in the example shown and described herein comprise socket head screws 78 which may be loosened and tightened in order to provide adjustment between the bracket 64 and sidewall 54. However, it will be appreciated that any other known or suitable fastener or fastening mechanism other than the exemplary socket head screws 78, could be employed. The bracket 64 includes an engagement portion 66 and a guide portion 68. In the example of FIG. 2, the bracket 64 includes a first guide portion 68 and a second guide portion 69 structured to receive the first and second moveable blocks 58, 59, respectively, as shown. The engagement portion 66 engages the side 10 of housing 6 of the power circuit breaker 2 at a first location, such as the recess 14, which is best shown in FIG. 3B. The first and second moveable blocks 58, 59 move within the guide portions 68, 69 of bracket 64 in order to engage the side 8, 10 at a second location, such as the generally horizontal bearing surfaces 16 on side 10, which are best shown in FIG. 1 (see also, generally horizontal bearing surface 16 on side 10 of housing 6 in FIG. 3B).

More specifically, the moveable blocks 58, 59 each include a number of slots 70, 72. One of the aforementioned lock screws 63 is disposed within each slot 70, 72. For instance, in the example of FIG. 2, each of the moveable blocks 58, 59 has a first slot 70 and a second slot 72 and a pair of such lock screws 63, as shown. Each moveable block 58, 59 also includes one jack screw adjustment mechanism 60. The jack screw 60 includes a threaded socket head screw 57 (partially shown in hidden line drawing on moveable block 58 of FIG. 2), and a lock nut 61 threaded onto the screw 57, and a lock washer 51 disposed between the lock nut 61 and the moveable block (e.g., 58).

In operation, the moveable blocks 58, 59 are adjusted within guide portions 68, 69 until the desired engagement at the generally horizontal bearing surfaces 16 (best shown in FIG. 1) is achieved. More specifically, the lock screws 63 are loosened in order to permit movement of the moveable blocks 58, 59 with respect to the lock screws 63 by way of first and second slots 70, 72. To effectuate such movement, the jack screw 60 is adjusted. In particular, with reference, for example, to first moveable block 58, the bottom (from the perspective of FIG. 2) lock nut 61 is turned or loosened in order that the socket head screw 57 of jack screw 60 can be adjusted to engage the tab 65 on bracket 64, thus pushing or moving the moveable block 58 downward (from the perspective of FIG. 2). In other words, the socket head screw 57 threads in and out of the moveable block 58 in order to extend or retract it within the guide portion 68. In this manner, the moveable blocks 58, 59 may be adjusted until the desired engagement with the power circuit breaker housing 6, is achieved. Once the desired engagement is accomplished, the lock screws 63 are then tightened in order to maintain the position of the moveable blocks 58, 59. Additionally, the lock nut 61 of the jackscrew 60 is then tightened in order to maintain the position of the jack screw 60. It will be appreciated that operation of the jack screw 60 of moveable block 59, in order to engage tab 67 and push or move moveable block 59 downward (from the perspective of FIG. 2) is accomplished in substantially the same manner.

All of the components of the adjustable mounting assembly 50 and, in particular, the bracket 64 and first and second moveable blocks 58, 59 are contemplated as being made from a metallic material, such as, for example and without limitation, nickel-plated steel. However, it will be appreciated that any known or suitable alternative material could be employed. Additionally, as previously discussed, the engagement portion 66 of the bracket may optionally include a resilient protector 74 for further resisting damage potentially caused by impact forces which are sustained by the power circuit breaker 2. In the example of FIG. 2, the resilient protector 74 is shown as a two-piece generally U-shaped plastic member disposed on the end of engagement portion 66. A substantially similar resilient protector 76 may optionally be disposed on each of the bottom ends (from the perspective of FIG. 2) of the first and second moveable blocks 58, 59. Each of these resilient protectors 74, 76 engages the housing 6 of the power circuit breaker 2, thus providing a more resilient and absorbent material than if the metallic material of engagement portion 66 and moveable blocks 58, 59 were to instead directly contact the housing 6.

FIGS. 3A and 3B show the power circuit breaker 2 and switchgear cabinet 5 (FIG. 3A) with the power circuit breaker device 12 mounted therein. (FIG. 3B only shows a portion of the power circuit breaker 2 and power circuit breaker device 12). The power circuit breaker device 12 is securely mounted within the cassette 4 by way of the adjustable mounting assembly 50 of the invention. Specifically, both sides 8, 10 (side 10 is not shown in FIG. 3B) of the housing 6 of the power circuit breaker 2 are engaged at recess 14 by engagement portion 66 of bracket 64, and also at generally horizontal bearing surface 16 (FIG. 3B) by first and second moveable blocks 58 (not shown in FIGS. 3A and 3B), 59 (FIG. 3B). The power circuit breaker device 12 and adjustable mounting assembly 50, assembled together, can roll or be drawn out of the cassette 4 mounted within enclosure 5, in order to be removed, to change, or for maintenance.

It will be appreciated that configurations and orientations of the various adjustable mounting assembly components other than those shown and described herein, could be employed without departing from the scope of the invention. For example, without limitation, a single moveable block (not shown) could be employed with any suitable number of adjustment and blocking mechanisms, as an alternative to the two moveable block configuration shown and described herein. In this manner, the adjustable mounting assembly 50 of the invention is capable of being readily adapted for use with a wide variety of different electrical switching apparatus, in order to mount such apparatus in a manner capable of withstanding impact (e.g., without limitation, shock and vibration) forces.

Accordingly, the adjustable mounting assembly 50 of the invention provides a mechanism for mounting a variety of different switchgear for use in environments where the switchgear is likely to sustain an impact or shock load, and for accommodating (e.g., absorbing; distributing; dissipating) such loads in a manner which substantially resists damage to the switchgear. More specifically, the adjustable mounting assembly 50 provides a variety of adjustment capabilities (e.g., adjustment of the bracket 64; adjustment of separate moveable blocks 58, 59) to ensure a close tolerance, secure fit of the switchgear with respect to the switchgear enclosure or cassette 4, which is permanently mounted within the secondary enclosure (e.g., without limitation, cassette; rack; cabinet).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An adjustable mounting assembly for an electrical switching apparatus including a housing, said electrical switching apparatus being structured to be disposed in an enclosure, said adjustable mounting assembly comprising:

a frame structured to couple said housing of said electrical switching apparatus to said enclosure;

a number of adjustable members structured to be disposed between said frame and said housing;

an adjustment mechanism coupled to each one of said adjustable members and structured to move said adjustable member into engagement with said housing;

a fastening mechanism structured to secure said adjustable member and said frame with respect to said housing, wherein said adjustable mounting assembly is structured to securely mount said frame and said electrical switching apparatus within said enclosure in order to resist damage potentially caused by an impact force sustained by said electrical switching apparatus;

wherein said housing of said electrical switching apparatus has a first side and a second side; wherein said frame comprises a first sidewall structured to be disposed opposite said first side of said housing, and a second sidewall structured to be disposed opposite said second side of said housing; and wherein said number of adjustable members includes at least one adjustable member disposed between each of said first sidewall of said frame and said first side of said housing, and said second sidewall of said frame and said second side of said housing; and wherein each of said first and second sidewalls includes a bracket having an engagement portion and a guide portion; wherein said at least one adjustable member is disposed within said guide portion of said bracket; wherein said engagement portion is structured to engage a corresponding one of said first and second sides of said housing of said electrical switching apparatus at a first location; and wherein said at least one adjustable member is structured to move within said guide portion of said bracket in order to engage said corresponding one of said first and second sides at a second location.

2. The adjustable mounting assembly of claim 1 wherein said adjustable member comprises a moveable block including a number of slots; wherein said fastening mechanism comprises a fastener disposed within each one of said slots; wherein when said adjustment mechanism is adjusted, said moveable block moves within said guide portion until engagement at said second location is achieved; and wherein when said engagement is achieved, said fastener is tightened in order to maintain the position of said moveable block.

3. The adjustable mounting assembly of claim 2 wherein said fastening mechanism comprises as said fastener, at least one lock screw; and wherein said adjustment mechanism comprises a jack screw.

4. The adjustable mounting assembly of claim 3 wherein said bracket includes as said guide portion, a first guide portion and a second guide portion; wherein said moveable block includes first and second moveable blocks disposed within said first and second guide portions, respectively; and wherein each of said first and second moveable blocks includes one said jack screw and further includes as said number of slots a first slot and a second slot each having one of said at least one lock screw disposed therein.

5. The adjustable mounting assembly of claim 3 wherein said adjustment mechanism further includes at least one locknut disposed on said jack screw; and wherein said locknut is structured to be tightened on said jack screw in order to further secure the position of said moveable block.

6. An electrical switching apparatus comprising:

a switchgear enclosure;

a housing including a first side and a second side;

an electrical switching device housed by said housing; and an adjustable mounting assembly for securely mounting said housing and said electrical switching device within said switchgear enclosure, said adjustable mounting assembly comprising:

a frame including a first sidewall disposed opposite said first side of said housing, and a second sidewall disposed opposite said second side of said housing, said frame coupling said housing of said electrical switching apparatus to said switchgear enclosure, at least one adjustable member disposed between at least one of said first and second sidewalls of said frame and a corresponding one of said first and second sides of said housing, an adjustment mechanism coupled to said adjustable member and being adjusted in order to move said adjustable member into engagement wit said corresponding one of said first and second sides of said housing, a fastening mechanism securing said adjustable member and said frame with respect to said housing, wherein said adjustable mounting assembly securely mounts said frame and said electrical switching device within said switchgear enclosure in order to resist damage potentially caused by an impact force sustained thereby;

wherein each of said first and second sidewalls of said frame includes a bracket having an engagement portion and a guide portion; wherein at least one of said at least one adjustable member is disposed within said guide portion of said bracket; wherein said engagement portion engages a corresponding one of said first and second sides of said housing of said electrical switching apparatus at a first location; and wherein said at least one of said at least one adjustable member moves within said guide portion of said bracket in order to engage said corresponding one of said first and second sides at a second location; and wherein said corresponding one of said first and second sides of said housing includes as said first location, a recess, and as said second location, a generally horizontal bearing surface.

7. An electrical switching apparatus comprising:

a switchgear enclosure;

a housing including a first side and a second side;

an electrical switching device housed-by said housing; and an adjustable mounting assembly for securely mounting said housing and said electrical switching device within said switchgear enclosure, said adjustable mounting assembly comprising:

a frame including a first sidewall disposed opposite said first side of said housing, and a second sidewall disposed opposite said second side of said housing, said frame coupling said housing of said electrical switching apparatus to said switchgear enclosure, at least one adjustable member disposed between at least one of said first and second sidewalls of said frame and a corresponding one of said first and second sides of said housing, an adjustment mechanism coupled to said adjustable member and being adjusted in order to move said adjustable member into engagement with said corresponding one of said first and second sides of said housing, a fastening mechanism securing said adjustable member and said frame with respect to said housing, wherein said adjustable mounting assembly securely mounts said frame and said electrical switching device within said switchgear enclosure in order to resist damage potentially caused by an impact force sustained thereby;

wherein each of said first and second sidewalls of said frame includes a bracket having an engagement portion and a guide portion; wherein at least one of said at least one adjustable member is disposed within said guide portion of said bracket; wherein said engagement portion engages a corresponding one of said fast and second sides of said housing of said electrical switching apparatus at a first location; and wherein said at least one of said at least one adjustable member moves within said guide portion of said bracket in order to engage said corresponding one of said first and second sides at a second location; and wherein said adjustable member comprises a moveable block including a number of slots; wherein said fastening mechanism includes a fastener disposed within each one of said slots; wherein when said adjustment mechanism is adjusted, said moveable block moves within said guide portion until engagement at said second location is achieved; and wherein when said engagement is achieved, said fastener is tightened in order to maintain the position of said moveable block.

8. The electrical switching apparatus of claim 7 wherein said fastening mechanism includes as said fastener, at least one lock screw; and wherein said adjustment mechanism comprises a jack screw.

9. The electrical switching apparatus of claim 8 wherein said bracket includes as said guide portion, a first guide portion and a second guide portion; wherein said moveable block includes first and second moveable blocks disposed within said first and second guide portions, respectively; and wherein each of said first and second moveable blocks includes one said jack screw and further includes as said number of slots, a first slot and a second slot each having one of said at least one lock screw disposed therein.

10. The electrical switching apparatus of claim 8 wherein said adjustment mechanism further includes at least one locknut disposed on said jack screw; and wherein said locknut is tightened on said jack screw in order to further secure the position of said moveable block.

11. An electrical switching apparatus comprising:

a switchgear enclosure;

a housing including a first side and a second side;

an electrical switching device housed by said housing; and an adjustable mounting assembly for securely mounting said housing and said electrical switching device within said switchgear enclosure, said adjustable mounting assembly comprising:

a frame including a first sidewall disposed opposite said first side of said housing, and a second sidewall disposed opposite said second side of said housing, said frame coupling said housing of said electrical switching apparatus to said switchgear enclosure, at least one adjustable member disposed between at least one of said first and second sidewalls of said frame and a corresponding one of said first and second sides of said housing, an adjustment mechanism coupled to said adjustable member and being adjusted in order to move said adjustable member into engagement with said corresponding one of said first and second sides of said housing, a fastening mechanism securing said adjustable member and said frame with respect to said housing, wherein said adjustable mounting assembly securely mounts said frame and said electrical switching device within said switchgear enclosure in order to resist damage potentially caused by an impact force sustained thereby;

wherein each of said first and second sidewalls of said frame includes a bracket having an engagement portion and a guide portion; wherein at least one of said at least one adjustable member is disposed within said guide portion of said bracket; wherein said engagement portion engages a corresponding one of said first and second sides of said housing of said electrical switching apparatus at a first location; and wherein said at least one of said at least one adjustable member moves within said guide portion of said bracket in order to engage said corresponding one of said first and second sides at a second location; and wherein said bracket is made from a metallic material; and wherein said engagement portion of said bracket includes a resilient protector for further resisting said damage potentially caused by said impact force.

12. An electrical switching apparatus comprising:

a switchgear enclosure;

a housing including a first side and a second side;

an electrical switching device housed by said housing; and an adjustable mounting assembly for securely mounting said housing and said electrical switching device within said switchgear enclosure, said adjustable mounting assembly comprising:

a frame including a first sidewall disposed opposite said first side of said housing, and a second sidewall disposed opposite said second side of said housing, said frame coupling said housing of said electrical switching apparatus to said switchgear enclosure, at least one adjustable member disposed between at least one of said first and second sidewalls of said frame and a corresponding one of said first and second sides of said housing, an adjustment mechanism coupled to said adjustable member and being adjusted in order to move said adjustable member into engagement with said corresponding one of said first and second sides of said housing, a fastening mechanism securing said adjustable member and said frame with respect to said housing, wherein said adjustable mounting assembly securely mounts said frame and said electrical switching device within said switchgear enclosure in order to resist damage potentially caused by an impact force sustained thereby;

wherein each of said first and second sidewalls of said frame includes a bracket having an engagement portion and a guide portion; wherein at least one of said at least one adjustable member is disposed within said guide portion of said bracket; wherein said engagement portion engages a corresponding one of said first and second sides of said housing of said electrical switching apparatus at a first location; and wherein said at least one of said at least one adjustable member moves within said guide portion of said bracket in order to engage said corresponding one of said first and second sides at a second location; and wherein said bracket is coupled to said first and second sidewalls of said frame by a plurality of fasteners; and wherein said fasteners are tightened and loosed in order to adjust said bracket thereby further facilitating adjustment and securement among said frame, said housing of said electrical switching apparatus, and said switchgear enclosure.

* * * * *